US006434789B1

(12) United States Patent
Kruse

(10) Patent No.: US 6,434,789 B1
(45) Date of Patent: Aug. 20, 2002

(54) SLIDING GLASS DOOR TRACK ENGAGEMENT AND METHOD

(75) Inventor: Frederick W. Kruse, Sarasota, FL (US)

(73) Assignee: PGT Industries, Inc., Nokomis, FL (US)

( * ) Notice: Subject to any disclaimer, the term of this patent is extended or adjusted under 35 U.S.C. 154(b) by 0 days.

(21) Appl. No.: 09/861,824

(22) Filed: May 21, 2001

(51) Int. Cl.[7] ..... A47H 15/00

(52) U.S. Cl. ..... 16/93 R; 16/100; 16/90; 49/425; 292/DIG. 46

(58) Field of Search ..... 16/93 R, 100, 16/90, 102, 101, 106, 94 R, 96 R, 96 D, 96 L; 49/425, 404, 410, 411; 52/207, 204.5; 292/DIG. 46

(56) References Cited

U.S. PATENT DOCUMENTS

| | | | | | |
|---|---|---|---|---|---|
| 809,695 | A | * | 1/1906 | Keil | 16/100 |
| 3,033,285 | A | * | 5/1962 | Banner | 16/106 |
| 3,281,993 | A | * | 11/1966 | Riegelman | 16/105 |
| 3,622,190 | A | * | 11/1971 | Mohun | 292/288 |
| 3,745,706 | A | * | 7/1973 | Stermac | 16/93 R |
| 3,956,854 | A | * | 5/1976 | Yamamoto | 16/100 |
| 4,633,615 | A | * | 1/1987 | Moose | 16/100 |
| 4,639,970 | A | * | 2/1987 | Adams | 16/100 |
| 5,148,630 | A | * | 9/1992 | Llorens | 16/100 |
| 5,884,361 | A | * | 3/1999 | Richardson et al. | 16/100 |

FOREIGN PATENT DOCUMENTS

| | | | |
|---|---|---|---|
| GB | 2302899 | A | * 2/1997 |

* cited by examiner

*Primary Examiner*—Chuck Y. Mah
(74) *Attorney, Agent, or Firm*—Jack E. Dominik

(57) ABSTRACT

A moveable sliding glass door track clip guide, ideally formed of plastic, and attached to the bead on the top of the rail on the sill which is subsequently secured in place by a sliding glass door track clip cover which will inhibit the door from jumping the track in strong wind loads. The guide contributes significantly to the general security of the SGD installation, since SGD's, by design, must be lifted then set upon their track. The guide slidably engages the upper bead on the track on the sill and thus resists the effort of the door to jump off the track by actually gripping the track itself. The method of the present invention involves the steps of first positioning a moveable panel in place. Thereafter, the main attachment screw is removed, and passed through the clip assembly. Only after the track clip guide has been positioned over the bead on the rail. The track clip cover is then secured over the track clip guide to lock the lower jaws of the track clip guide against any scissor-like action which would assist in dislodging the same.

6 Claims, 7 Drawing Sheets

SLIDING GLASS DOOR TRACK ENGAGEMENT AND METHOD

FIELD OF THE INVENTION

The present invention relates primarily to sliding doors (hereinafter SGD), and more particularly to sliding glass doors in residential applications. More specifically, the present invention is directed to means for securing a sliding glass door to the track which will assist in primarily resisting wind loads against the door which would tend to bow the door and raise the same off the track.

BACKGROUND OF THE INVENTION

The field of the invention relates primarily to sliding glass doors(SGD) in which normally one or more panels are moveable and one or more panels are fixed. These are definitely old in the art. Most sliding glass door panels ride on a track or sill which has one or more rails, and the door panel has rollers on the lower portion which ride on the rails. While one or more of the panels may be sliding and one or more of the panels may be fixed, both panels are usually identical and equipped with rollers so that either can be a sliding panel. However, during installation, brackets are used in order to secure at least one of the panels as a fixed panel even though it has the rollers at the bottom which equips it to be a moveable panel. In many instances the entire door opening is half mobile and sliding, and the other half is permanently fixed. In such an environment the panels overlap in the open configuration. It is in the closed configuration that the problem arises, particularly with strong wind loads. Wind loads have been known to cause a bow of up to 5 inches in a 7 or 8 foot door. Once that occurs, the cord of the arc of the door which is deformed becomes less than the distance between the head and the sill of the frame. The bottom wheels are likely to jump off the rail located on the sill, and the sliding portion moves into the dwelling. The problem, of course, is how to resist the tendency to "jump the track" within the economical parameters of manufacture, and without diminishing the aesthetic appearance of the door.

SUMMARY OF THE INVENTION

This invention derives from the discovery of mounting a sliding glass door track clip guide, ideally formed of plastic, to the bead on the top of the rail in the sill which is subsequently secured in place by a sliding glass door track clip which will inhibit the door from jumping the tract in strong wind loads. In addition, this contributes significantly to the general security of the SGD installation, since SGD's, by design, must be lifted then set upon their track. The guide slidably engages the upper bead on the track on the sill and thus resists the effort of the door to jump off the track by actually gripping the track itself. More specifically a plastic type track clip guide is secured immediately at the end of the lower corner of the door in which a guide hole, large enough to encapsulate the bead of the rail, is provided in the lower portion of the track clip guide. A spread or scissors slot extends from the bottom of the track clip guide to the primary attachment slot which permits the lower portion of the clip to be widened at the time of installation by scissoring over the bead on the rail and then relaxing to where the guide hole surrounds the bead on the rail. The method of the present invention involves the steps of first positioning the panel in place. Thereafter, the main attachment screw is removed, and passed through the clip assembly. This is done only after the track clip guide has been positioned over the bead on the rail. Subsequently the track clip cover is secured over the track clip guide to lock the lower jaws of the track clip guide against any scissor-like action which would assist in dislodging the same. The method also contemplates utilizing the end of the lower portion of the sliding glass door which overlaps an adjacent panel, irrespective of whether the adjacent panel is moveable or fixed.

In view of the foregoing, it is a principle object of the present invention to devise a retrofit means for a sliding door, or means which can be employed with the original equipment, which permits the door itself to more securely engage the track on the sill, particularly where the track has a bead on the top. This objective is achieved when the clamp is in place and it resists the tendency of the door to bow and jump the track.

Another object of the present invention is to add the desirable feature of additional resistance to removal from the track without significantly increasing the cost of the door.

DESCRIPTION OF ILLUSTRATIVE EMBODIMENTS

Further objects and advantages of the present invention will be best understood in conjunction with the accompanying illustrative drawings in which.

THE PRIOR ART

Figure 1:
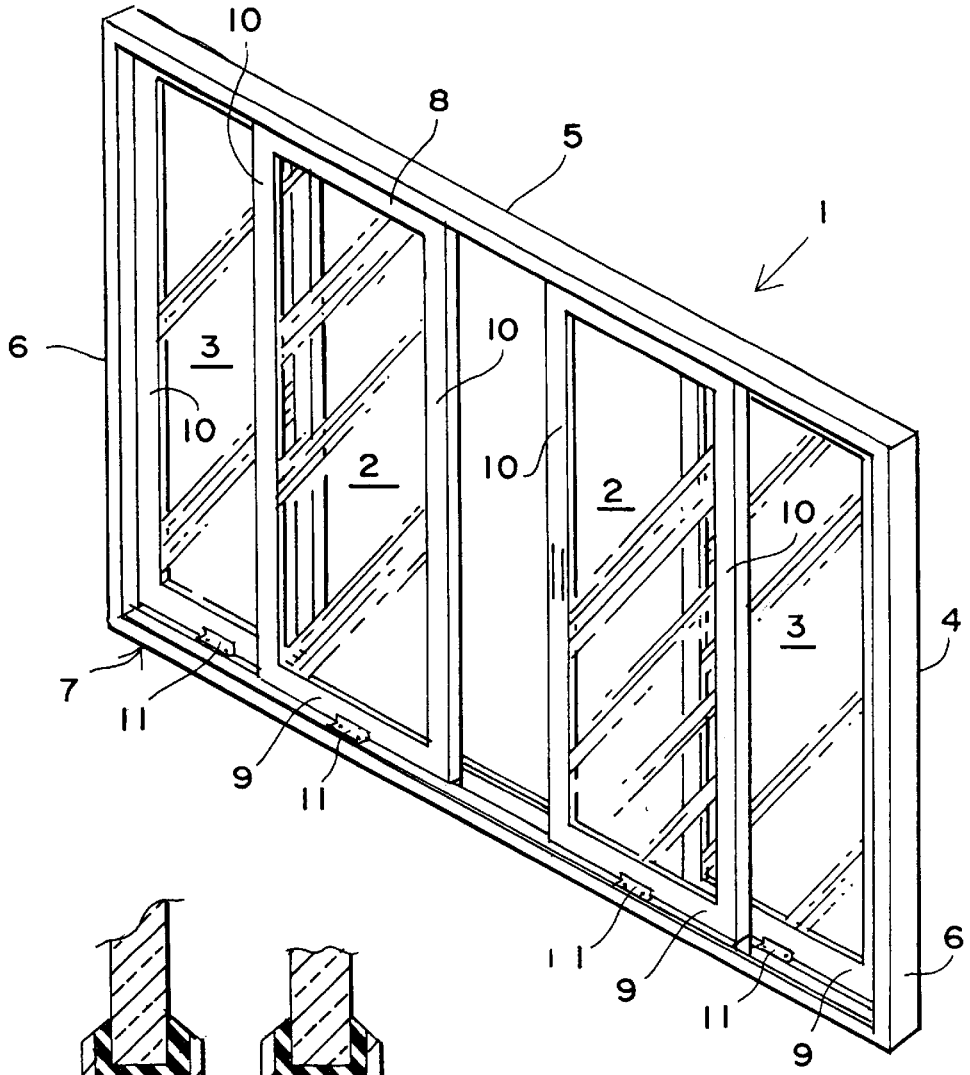
FIG. 1 is an isometric view of an illustrative sliding glass door assembly having two central moveable panels flanked by end fixed panels.

The prior art is best illustrated in FIG. 1 through 10. As shown in FIG. 1, the sliding glass door (SGD) 1 includes a sliding panel 2 and a moveable panel 3. In the present instance, there are two moveable panels 2, and two fixed panels 3. As set forth previously, the moveable panel 2 and the fixed panel 3 are, for the most part, both identical. They differ mainly in that the fixed panel is secured in place, as will be described hereinafter. The panels 2, 3 are enclosed in a frame 4. The frame 4 has a head 5, two vertical jams 6 and a sill 7. The sill 7, as will be described hereinafter, includes rails 12 upon which the moveable panel 2 rides, and upon which the fixed panel 3 is fixed.

Figure 2:
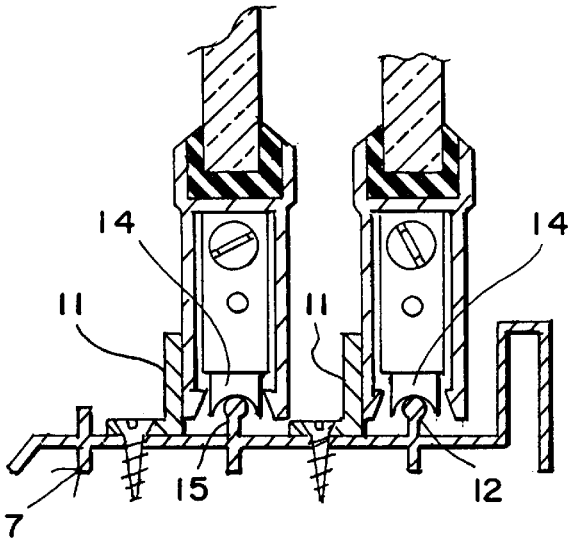
FIG. 2 is a cross-section showing the configuration of the two panels and how a retainer angle has been employed in the prior art to assist in reducing the tendency of the panel to jump the track.

Each of the panels 2, 3 include a panel top 8, a panel bottom 9 and panel stiles 10, the stiles being the two lateral vertical edge portions. As shown in FIG. 2, the frame sill 7 has a plurality of rails 12. The top of each rail 12 is an enlarged portion referred to herein as a bead 15.

The rail, bead, and wheels 14 of the panels 2, 3 are shown in cross-section in FIG. 2. Retainer angles 11 have been used in the prior art, as shown in both FIGS. 1 and 2, to help resist dislodgement by jumping off the track due to strong winds which can cause an interior vacuum or pressure in the dwelling. The retainer angles 11 are relatively unsightly, and can be tripped over when the panel is open or not overlapping the retainer angle 11. Moreover, the retainer angles 11 do not grip the fixed panel 3 or the rail 12.

Figure 3:
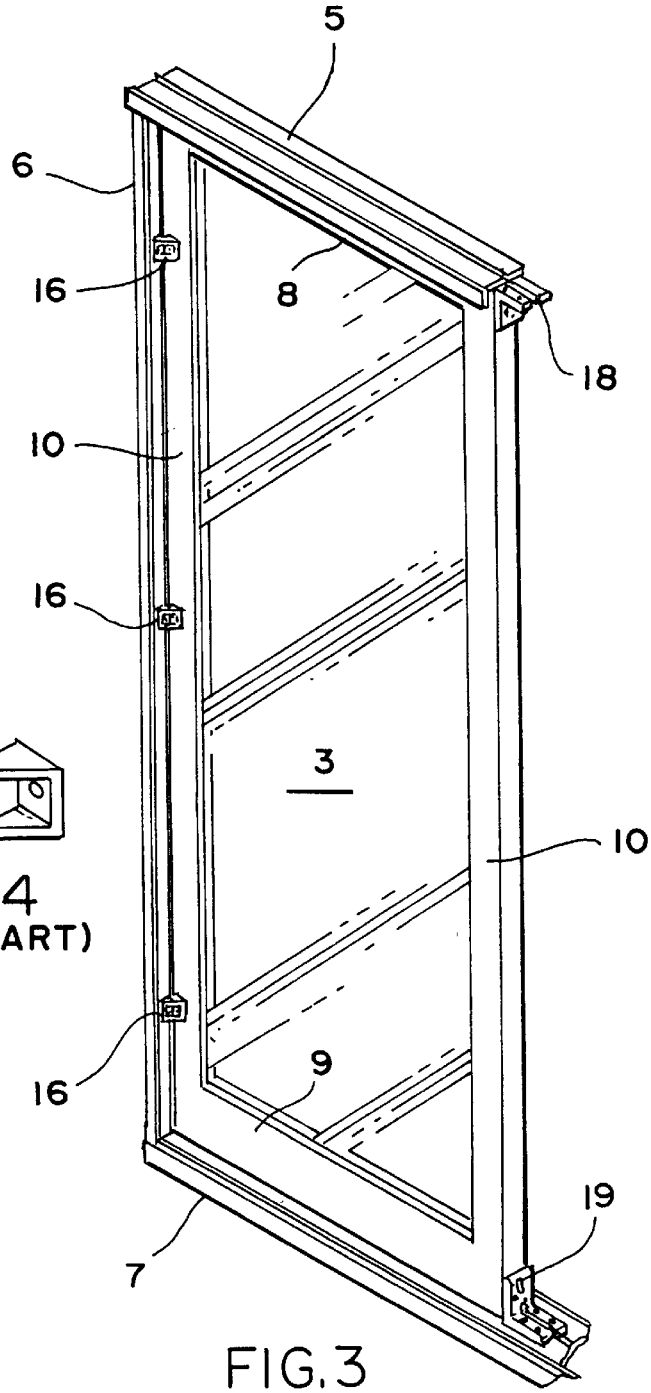
FIG. 3 (PRIOR ART)
FIG. 3 is a partially broken view of the door shown in FIG. 1 showing how the fixed panel is secured in place by a clip which joins the jam of the frame and upper and lower fixed panel brackets which secure the panel and render it immovable.
Figure 4:
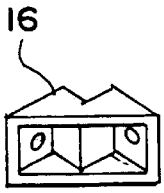
FIG. 4 (PRIOR ART)
FIG. 4 is a perspective view of the clip utilized between the fixed panel and the jam.
Figure 5:
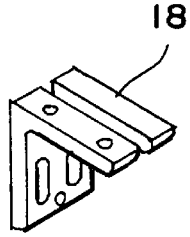
FIG. 5 (PRIOR ART)
FIG. 5 is a perspective view of the fixed panel bracket used at the top.
Figure 6:
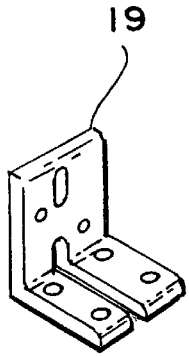
FIG. 6 (PRIOR ART)
FIG. 6 is a perspective view of the fixed panel bracket used at the bottom.

Turning now to FIG. 3, it will be seen that the panel 3 becomes a fixed panel when plastic clips 16 secure the stile of the panel 2, 3 to the jam 6 of the frame 4. A fixed panel top bracket 18 and a fixed panel bottom bracket 19 are secured to the ends of the panel top 8 and panel bottom 9 and then further secured to the frame head 5 and the sill 7. This effectively converts a sliding panel 2 into a fixed panel 3, even though the panels are predominantly identical.

Figure 7:
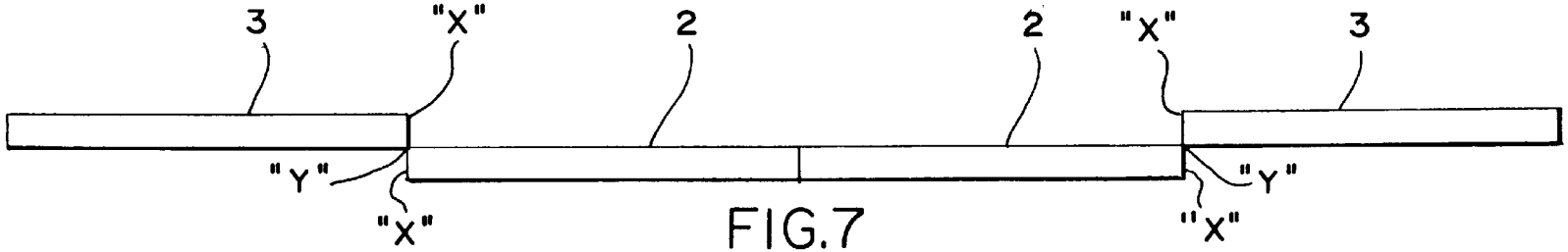
FIG.7 (PRIOR ART)
FIGS. 7–10 show in sequence and diagrammatically the door of FIG. 1 in FIG. 7 identifying the ideal location for the reinforcement clip illustrative of the present invention, location X identified on each is the central portion of the fixed panel and location Y is the overlapping portion where the moveable panel overlaps the X portion of the fixed panel.
Figure 8:
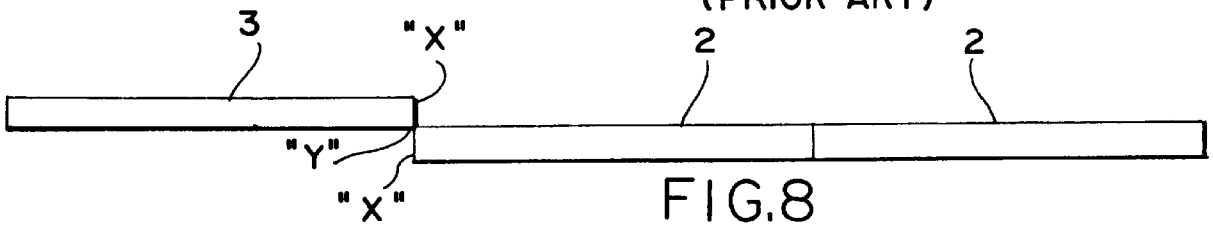
FIG.8 (PRIOR ART)
Figure 9:
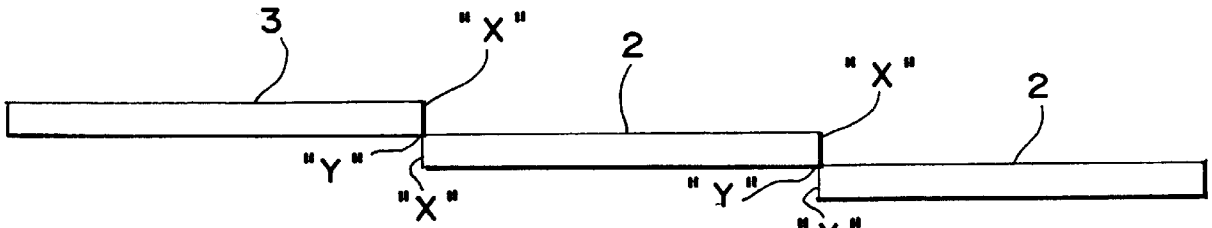
FIG.9 (PRIOR ART)
Figure 10:
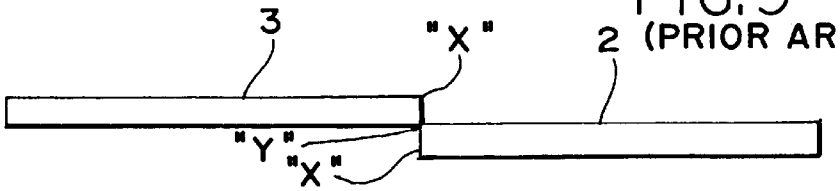
FIG.10 (PRIOR ART)

Bearing in mind the location of the fixed panels 2 and moveable panels 3, four combinations are shown in FIGS. 7, 8, 9 and 10. In FIG. 7, for example, the lineup is essentially the same as the lineup in FIG. 1. The lateral panels are the fixed panels 3 and the central two panels are the moveable panels, or sliding panels 2. The ideal location for securing the panels against wind loads is where location X, which is the innermost end of the fixed panel, overlaps location Y on the moveable panel. This relationship is shown in all of FIGS. 7, 8, 9 and 10. In the event all of the panels are moveable, then the desirable location for the reinforcement illustrative of the present invention will be where the lateral edges overlap in the closed door configuration.

Figure 11:
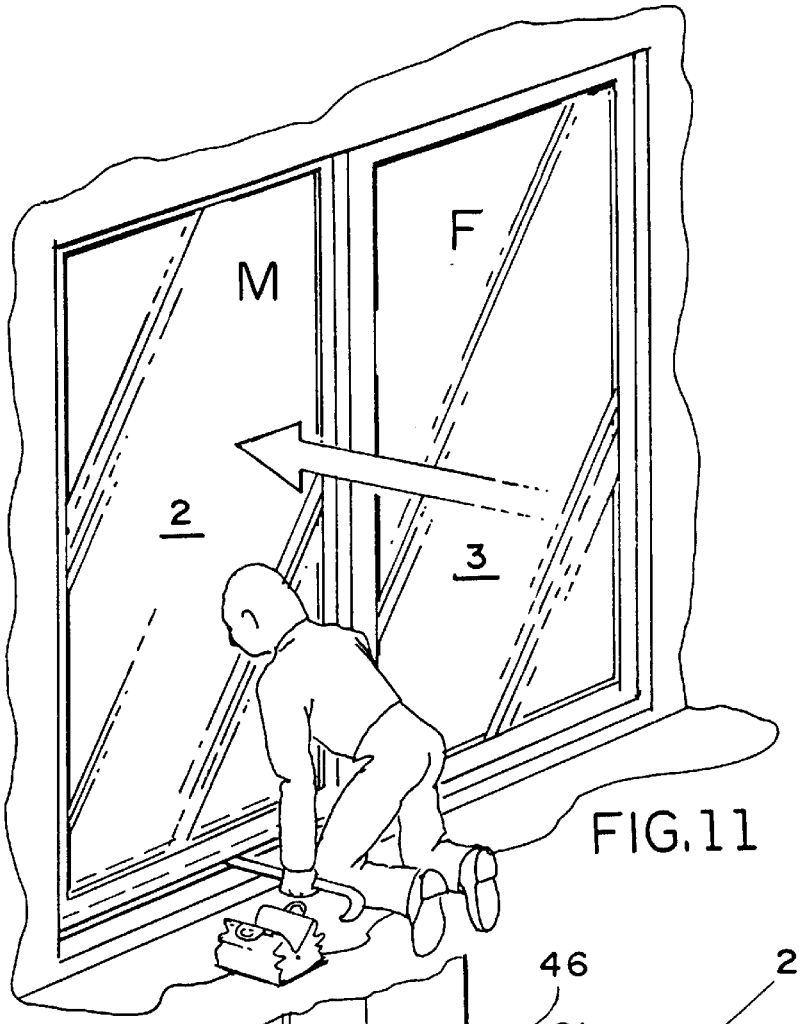
FIG. 11 illustrates diagrammatically the moving action that occurs with the moveable panel identified as M and the fixed panel identified as F, and also shows how an unwanted intruder may remove the removable door Z with a crow bar or comparable tool.

Turning now to FIG. 11, it will be seen how a strong wind forces the moveable panel or sliding panel 2 to move inwardly or bow with the fixed panel 3. This can be a function of exterior wind blowing at the panel causing a vacuum or pressure inside the dwelling, but most likely a combination of both. Once the bowing reaches approximately 4 inches, the shortening of the panels can reach approximately 0.440 inches. This is sufficient for the moveable door to "jump the track".

THE PREFERRED EMBODIMENT

Figure 12:
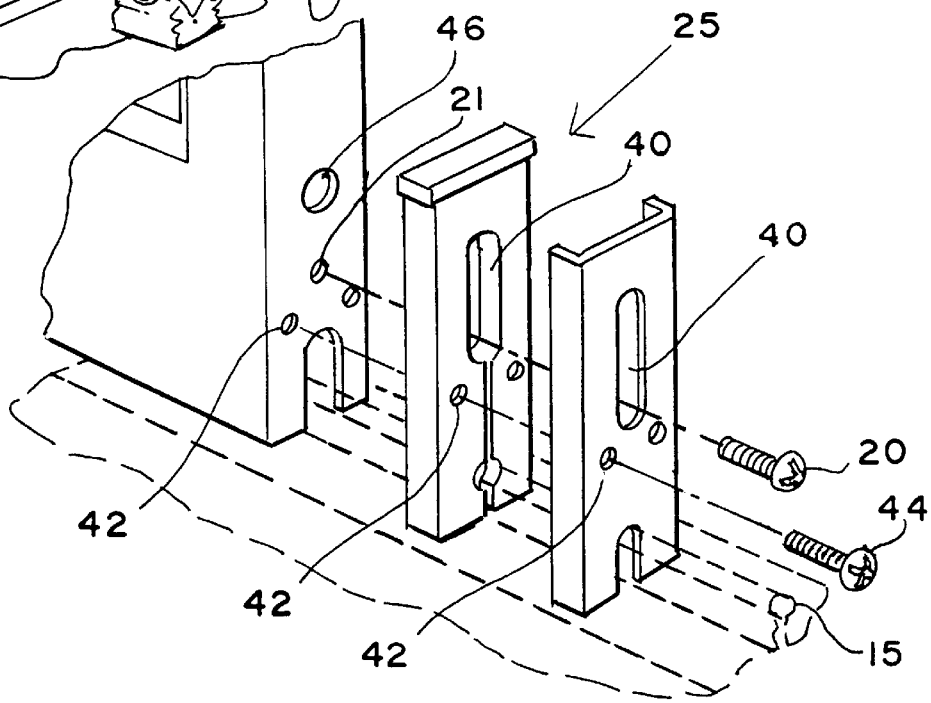
FIG. 12 is a diagrammatic, partially broken, perspective view of the clip assembly illustrative of the present invention.
Figure 13:
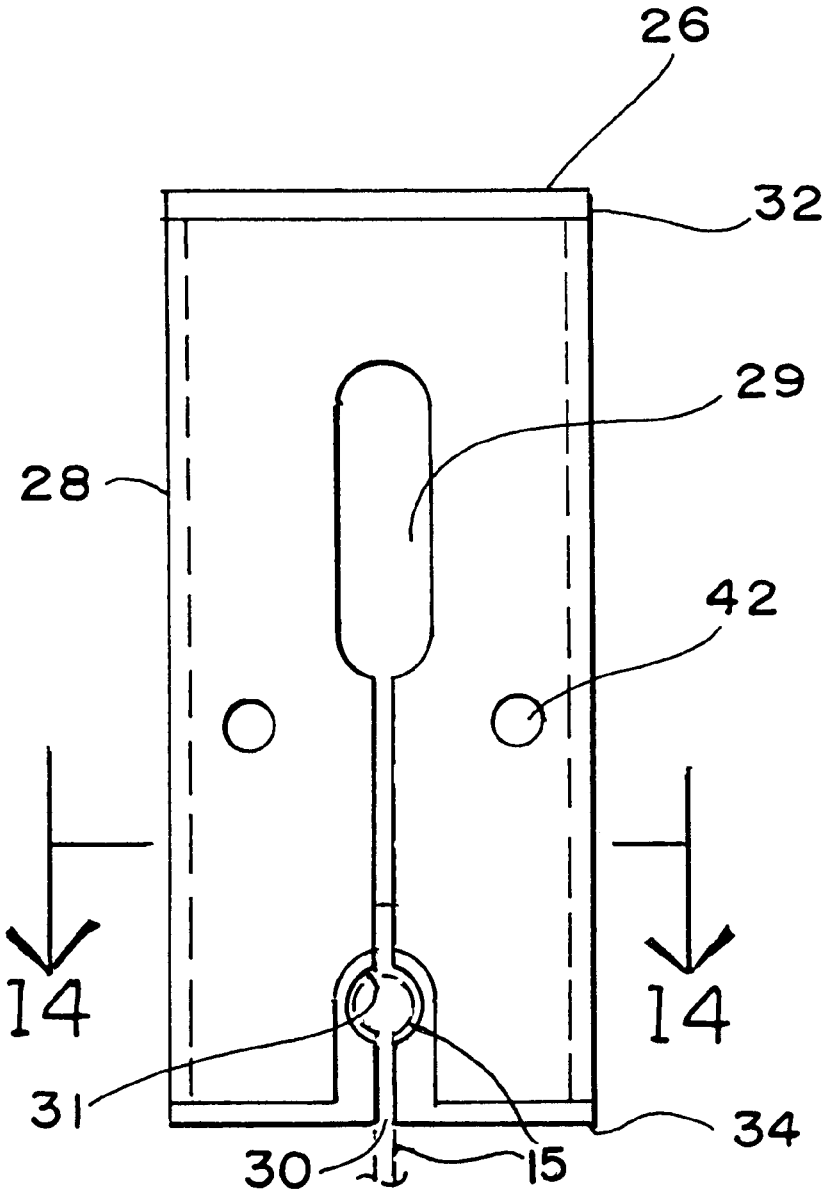
FIG. 13 is a front elevation of the clip assembly.
Figure 14:
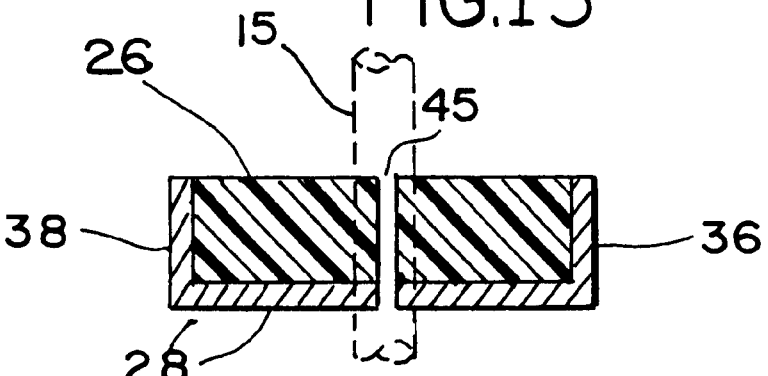
FIG. 14 is a transverse sectional view in the same scale as FIG. 13, taken along section line 14—14 of FIG. 13.
Figure 15:
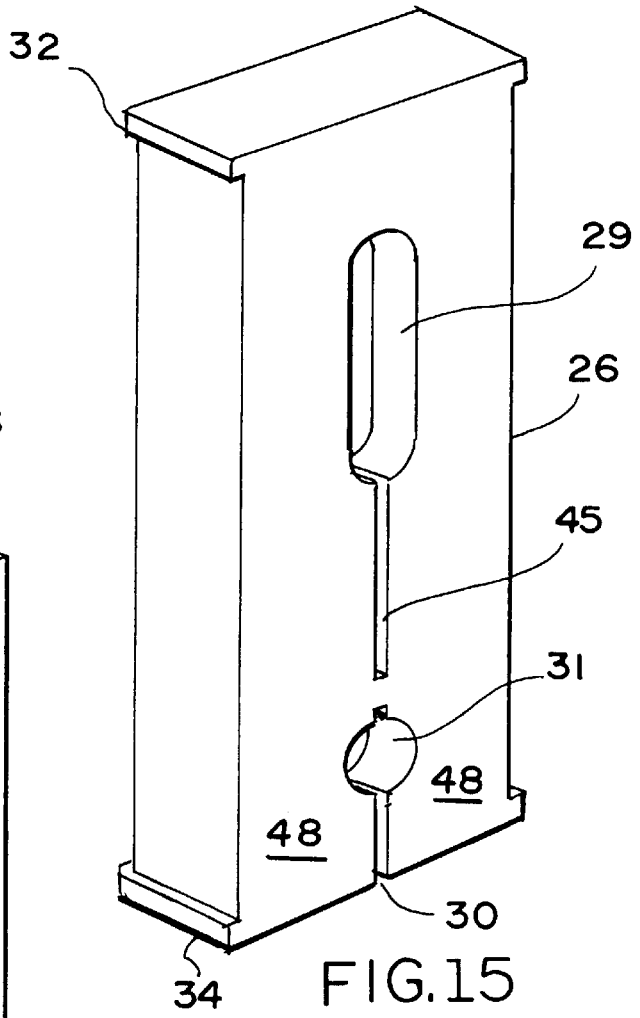
FIG. 15 is a perspective view of the SGD track clip guide, manufactured ideally of plastic.

It is to inhibit the above prior art dislodgement by bowing that the clip assembly 25, as shown in broken perspective exploded view in FIG. 12 is employed. The assembly 25 include primarily the SGD track clip guide 26 and the SGD track clip cover 28. The track clip guide 26 has centrally a primary attachment slot 29. Beneath the primary attachment slot 29 is a spread slot or scissors spread slot 30 which permits the lower portion of the track clip guide 26 to expand and position the guide hole 31 over the bead 15 of the rail 12. To be noted also are top shoulder 32 and bottom shoulder 34 molded into the plastic body of the track clip guide 26.

Figure 16:
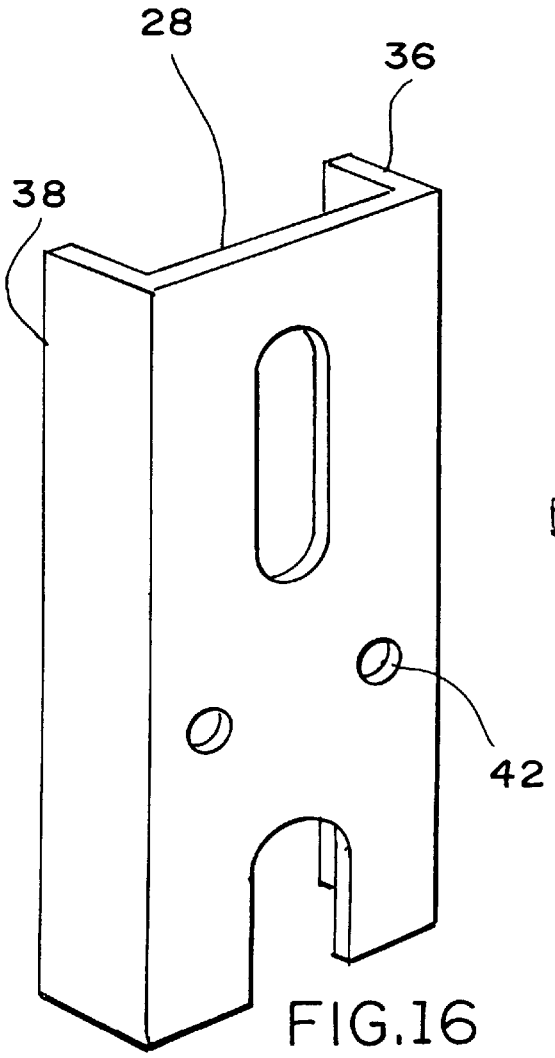
FIG. 16 is a perspective view of the SGD track clip cover normally manufactured of metal.

Turning now to FIG. 16, the SGD track clip cover 28 is shown and is basically a coated extruded metal part which is punched to take the configuration as illustrated. The product is normally powder coated with paint. When the extrusion is punched, raw edges are left which are not painted. Therefore, the two legs 36 and 38 of the track clip cover nest underneath the top shoulder and bottom shoulder of the track clip guide 26.

A primary attachment slot 40 is punched in the upper portion of the track clip cover 28. As shown previously in FIG. 12, the existing attachment screw 20 is removed from the panel 2, 3 and then serves to secure both the track clip guide 26 and the track clip cover 28 to the door panel stile when secured in attachment door hole 21. Further provision is made in the track clip cover 28 for anti-rotation screw mounts 42, at least one of which accepts the anti-rotation screw 44, to secure against the track clip cover 28. The assembly 25 covers the panel adjustment access hole 46 to prevent further vertical adjustment of the panel. The scissor lock 45 is a recess at the bottom of the track clip cover 28 and opposed jaws 48 at the lower portion of the track clip guide 26. These jaws 48 actually engage in a scissors-like action at the point of installation where the spread or scissors slot 30 permits the two jaws 48 to separate themselves from each other and slide over the bead 15 of the rail 12. Once the track clip cover 28, normally formed of metal, is in place, it secures the two jaws 48 from engaging in a scissors-like action, and therefore strongly engages the rail by the end of the sliding panel 2.

While dimensions and materials are not necessarily critical to the invention, it has been found that the clip assembly can ideally be manufactured utilizing a 6061-T6 aluminum for the extrusion to form the track clip cover 28 and the track clip guide 26 is ideally manufactured of 6/6 nylon which provides for strength and the lubricity desired when engaging the rails 12 and beads 15.

Figures 17, 18, 19, 20, 21, 22:
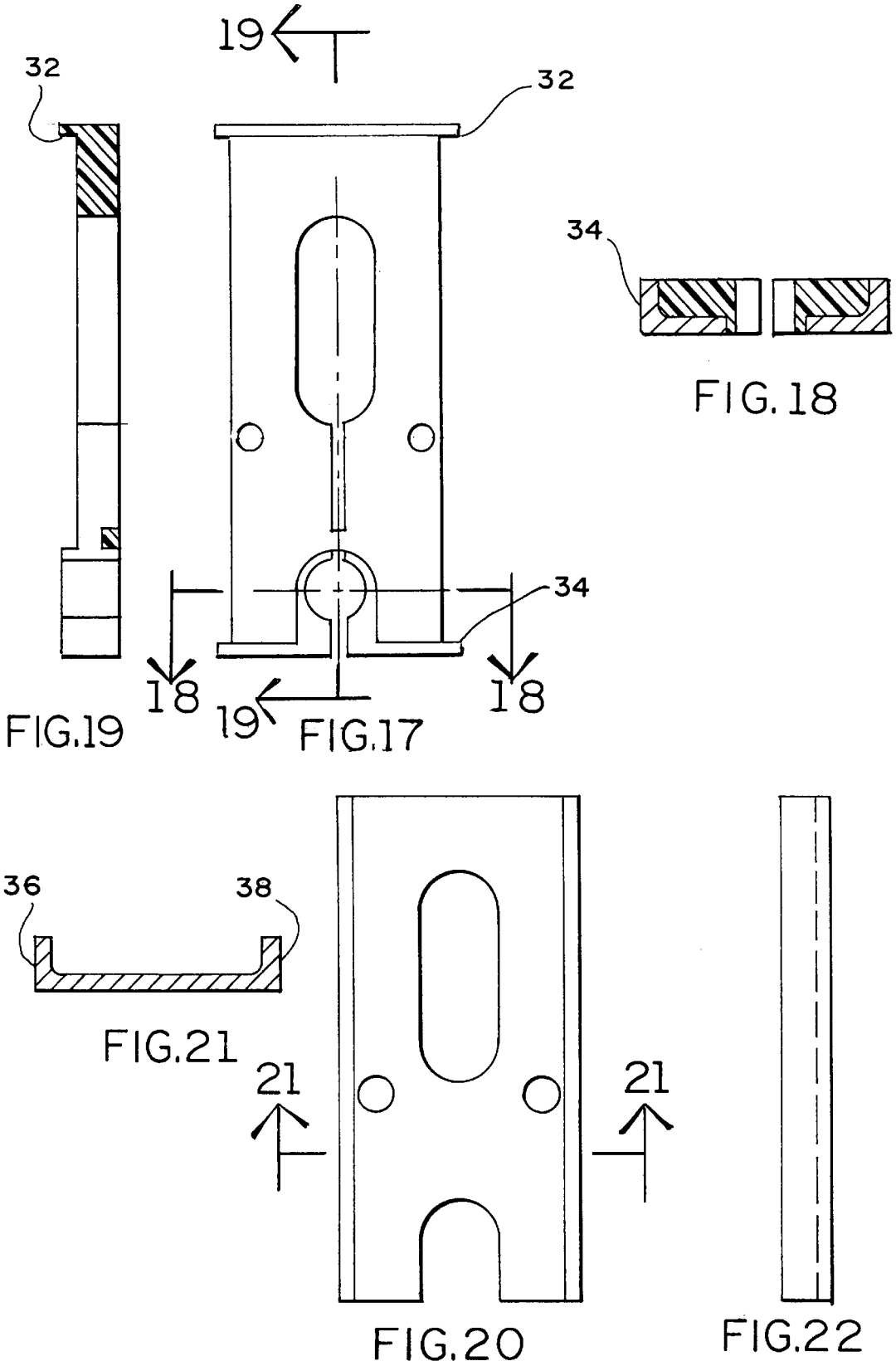
FIG. 17 is a front elevation of the track clip guide identifying the bulk of the dimensions.
FIG. 18 is a section line 18—18 of FIG. 17.
FIG. 19 is a section line 19—19 of FIG. 17.
FIG. 20 is a back elevation of the track clip cover.
FIG. 21 is a top view of the track clip cover.
FIG. 22 is a side view of the track clip cover.

FIGS. 17, 18 and 19 show the track clip guide 26. The overall height inside the shoulders 34 is 1.837 inches. The elongate central attachment screw slot 40 is 0.750 inches in length, and 0.256 inches in width. The width of the guide 26 is 0.750 inches. Specifically the bottom shoulder 34, top shoulder 32, and legs 36 are designed to nestingly receive the track clip cover 28 of the clip assembly 25. The anti-rotation screw mounts 42 are positioned beneath the elongate slot 40. The elongate slot 40 receives the attachment screw 20.

Referencing FIG. 20, the overall height of the clip cover plate 28 is 1.830 inches (see particularly FIG. 22) with the total width being 0.880 inches. These are the intended dimensions for one commercial embodiment, but illustrative of the proportions which are employed. For varying size doors, and track installations, these dimensions will undoubtedly change to some degree. Turning now to FIG. 21 it will be seen that the inside spacing between the two legs of the clip cover 36, 38 is 0.755 inches. The height of the legs above the back plate is 0.125 inches.

THE METHOD

The method of the present invention necessarily includes a track clip guide 26 and a track clip cover 28 for a clip assembly 25 but also includes the selection of the optimum location to position the clip assembly 25. The method also includes the sequential installation of the clip assembly 25.

Bearing the foregoing propositions in mind, the method contemplates first installing the panels 2, 3 so that at least one is moveable. Thereafter, the method involves leveling both panels and then securing the subject clip assembly to the end of the moveable panel 2 which overlaps the fixed panel 3. This is done by removing the attachment screw 20 and then passing the attachment screw 20 through the clip assembly 25 and securing the same in place. The clip assembly, in turn, is first installed by scissoring the plastic clip onto the bead of the rail 15, 12 and then covering with the plate to secure the plastic so that it will not dislodge due to the reverse scissoring of the jaws 48. Thereafter a single screw 44 is applied to lock the clip assembly 25 against rotation and dislodgement. Where multiple panels are involved, the clip assembly 25 is ideally positioned where a moveable panel overlaps a lateral edge of a fixed panel. It is also within the contemplation of the invention that the clip assembly 25 can be applied to both lower corners of the moveable panel, particularly where two moveable panels may overlap each other. In addition, the clip assembly 25 may be applied at various locations for aesthetic balance as well as additional strength.

It will be understood that various changes in the details, materials and arrangements of parts, or method which have been herein described and illustrated in order to explain the nature of the invention, may be made by those skilled in the art within the principle and scope of the invention as expressed in the appended claims.

What is claimed is:

1. In a sliding glass door having a panel roller means at the lower portion for engaging a sill which sill has a rail with a bead at the top of the rail, comprising:

a clip assembly for securement to the door at a lower corner portion;

said clip assembly having means for adjustably securing the assembly to the door; and said clip assembly having a recess formed in the lower portion with a scissor lock cut out for receiving the rail bead of the sill; whereby the securement of the door panel, in addition to the gravity weight of the door on the track, relies on the clamping action of the subject clip assembly to resist raising the door off of the track attributable to any lateral or vertical force.

2. In a sliding glass door having a panel roller means at the lower portion for engaging a sill which sill has a rail with a bead at the top of the rail, comprising:

a clip assembly for securement to the door at a lower corner portion;

said clip assembly having means for adjustably securing the assembly to the door; and said clip assembly having a recess formed in the lower portion with a scissor lock cut out for receiving the rail bead of the sill;

said scissors lock having opposed jaws to ride beneath the rail bead;

whereby the securement of the door panel, in addition to the gravity weight of the door on the track, relies on the clamping action of the subject clip assembly to resist raising the door off of the track attributable to any lateral or vertical force.

3. In a sliding glass door having roller means at the lower portion for engaging a sill, which sill has a rail with a bead on the top of the rail, comprising, in combination:

a clip assembly for securement to the door at a lower corner portion;

said clip assembly being made up of two members, the first member being a track clip guide formed from a material permitting it to bend and slidably engage the rail;

a keyhole slot formed in the lower portion of the track clip guide which is basically the silhouette of a cross-section of the sill rail; and said assembly also including a track clip cover which is secured outside the track clip guide and is basically complementary in size for clamping securing the track clip guide to the door;

means for removably securing the guide to the rail; whereby the securement of the door to the rail relies not only on the weight of the door itself, but also to the clamping action of the subject clip assembly to the bead on the rail to resist raising the door off of the track which is attributable to any lateral or vertical force which exceeds normal usage.

4. In a sliding glass door hating roller means at the lower portion for engaging a sill, which sill has a rail with a bead on the top of the rail, comprising, in combination:

a clip assembly for securement to the door at a lower cornet portion;

said clip assembly being made up of two members, the first member being a track clip guide formed from a material permitting it to bend and slidably engage the rail;

a keyhole slot formed in the lower portion of the track clip guide which is basically the silhouette of a cross-section of the sill rail including a bead cut out;

said assembly also including a track clip cover which is secured outside the track clip guide and is basically complementary in size for clamping securing the track clip guide to the door; and means for removably securing the guide to the rail;

whereby the securement of the door to the rail relies not only on the weight of the door itself, but also to the clamping action of the subject clip assembly to the bead on the rail to resist raising the door off of the track which is attributable to any lateral or vertical force which exceeds normal usage.

5. The method of securing a sliding glass door for resisting dislodgement from a track in which said sliding glass door engages a sill and in which the sill has a rail with an upper bead upon which the sliding glass door is slidably engaged, comprising the steps of:

forming a clamping plate assembly with a recess at the lower portion for receiving the rail bead of the subject sill;

first forming the yieldable clamping member with a keyhole slot, essentially the silhouette of a cross-section of the subject rail with jaws for positioning beneath the bead;

thereafter forming a clamping plate to secure the clamping member with the keyhole slot onto the rail;

forcing the first member with the keyhole slot onto the rail in which a scissor-like action occurs as the keyhole slot portion engages the rail and the jaws extend beneath the rail bead; and thereafter securing the clamping plate to the rail engaging member overlying a substantial portion of the lower portion of the rail engaging member to inhibit the scissor-like effect which might occur on dislodgement when a heavy load is applied; whereby the sliding glass door is secured by the clamping assembly in addition to the gravitational effect of the door on the sill.

6. The method of securing a sliding glass door for resisting dislodgement from a track in which said sliding glass door engages a sill and in which the sill has a rail with an upper bead upon which the sliding glass door is slidably engaged, and which door has removable attachment means at a lower comer which is first removed prior to securing the door, comprising the steps of:

temporarily removing the removable attachment means;

forming a clamping plate assembly of a flexible material in that portion which engages the rail bead and which has a recess at the lower portion for receiving the rail by opposed jaws positioned beneath the rail bead on the subject sill; and thereafter securing the clamping assembly to the door and to the track on the sill by replacing the removable attachment means;

whereby the sliding glass door is secured by the clamping assembly in addition to the gravitational effort of the door on the sill.

* * * * *